US005649498A

United States Patent [19]

Zigurs

[11] Patent Number: 5,649,498

[45] Date of Patent: Jul. 22, 1997

[54] DUAL-HULLED KAYAK

[76] Inventor: Vilis J. Zigurs, 0222 Ronce La., Carbondale, Colo. 81623

[21] Appl. No.: 609,060

[22] Filed: Mar. 4, 1996

[51] Int. Cl.[6] ..... B63B 1/00

[52] U.S. Cl. ..... 114/61; 114/347

[58] Field of Search ..... 114/61, 123, 282, 114/283, 292, 343, 347, 363, 362

[56] References Cited

U.S. PATENT DOCUMENTS

| | | | |
|---|---|---|---|
| 421,806 | 2/1890 | Bailey | 440/106 |
| 3,593,684 | 7/1971 | Cogliano . | |
| 4,223,620 | 9/1980 | Dudouyt . | |
| 4,271,549 | 6/1981 | Chandler . | |
| 4,517,911 | 5/1985 | Seefeld | 114/61 |
| 4,817,548 | 4/1989 | Guergen . | |
| 4,828,517 | 5/1989 | Van Liefland | 114/61 |
| 4,856,446 | 8/1989 | Herard . | |
| 5,013,270 | 5/1991 | Walls . | |
| 5,086,721 | 2/1992 | Burkard . | |
| 5,174,232 | 12/1992 | Boddy . | |
| 5,189,974 | 3/1993 | Masters . | |
| 5,203,276 | 4/1993 | Methven | 114/61 |

*Primary Examiner*—Stephen Avila

*Attorney, Agent, or Firm*—Niro, Scavone, Haller & Niro

[57] ABSTRACT

A dual-hulled kayak useful in white water recreational activities is disclosed and includes a rigid frame structure that carries a plurality of oar pins to support oars on each side of the frame structure. The dual-hulled kayak is capable of supporting two or more persons and provides a stiff, rigid boat structure. Because of the oar pins, the kayak can be rowed, rather than paddled, which allows greater control.

6 Claims, 2 Drawing Sheets

DUAL-HULLED KAYAK

BACKGROUND OF THE INVENTION

This invention relates to a dual-hulled kayak that is particularly useful for while water recreational activities. Kayaks are typically single hull, single person boats that include an internal cockpit seat capable of accommodating a single boater. Because of their design, kayaks can easily become unstable under turbulent water conditions.

With the increase of popularity of kayaking and white water boating, however, a need has arisen to combine the kayaking experience with a more stable boat structure that accommodates more than one boater and can be used for rowing applications, instead of paddling.

Catamaran-type boats having a pair of spaced paralleled pontoons, such as disclosed in U.S. Pat. No. 4,271,549, are known. Such structures include frame structures and external seats, but do not include oar pins and oars such that the catamaran can be effectively used in white water river rapids.

Kayak-catamarans, such as disclosed in U.S. Pat. No. 5,189,974, are also known. Such structures tie together two adjacent kayaks and allow two boaters separately seated over each kayak to paddle through white water. The frame structure in these boats, however, is intended to be flexible to provide the customized experience for the persons seated in the adjacent kayaks. As an example, flexible couplings are provided so the hulls move relative to each other and remain flexible and resilient, rather than being stabilized.

SUMMARY OF THE INVENTION

The present invention permits two separate kayak hulls to be rigidly joined to form a relatively stiff, inflexible structure capable of seating one or more persons between the adjacent hulls, rather than over them. A rectangular frame structure associated with the two hulls stiffens the boat structure and improves its performance in severe rapids. The hulls, however, are shaped like conventional kayaks and are designed to slice through waves in a highly responsive fashion because of the pointed or angled hull profile and its lightweight construction. In the present invention, the frame structure accommodates adjustable oar pins which allow the kayak to be rowed, rather than paddled. The stiffness of the frame and the resultant rigidity of the boat structure also improves performance under severe conditions.

The two laterally-spaced hulls of the general design illustrated in U.S. Pat. No. 5,189,974 are sold commercially under the name "REVOLUTION" have been found particularly suitable for use in the present invention. The two adjacent hulls are joined and rigidly secured by a rectangular frame structure in which two interconnecting longitudinally spaced frame members are joined with four intersecting lateral frame members to form a rigid structure. The two outermost lateral members accommodate a plurality of oar pins to support oars on each side of the kayak structure adjacent forward and aft seats. The two longitudinally spaced frame members fit under a molded recess formed in each of the hulls.

BRIEF DESCRIPTION OF THE DRAWINGS

A preferred embodiment of the invention is described below and can be more readily understood by reference to the accompanying drawings.

DESCRIPTION OF THE PREFERRED EMBODIMENT

Figure 1:
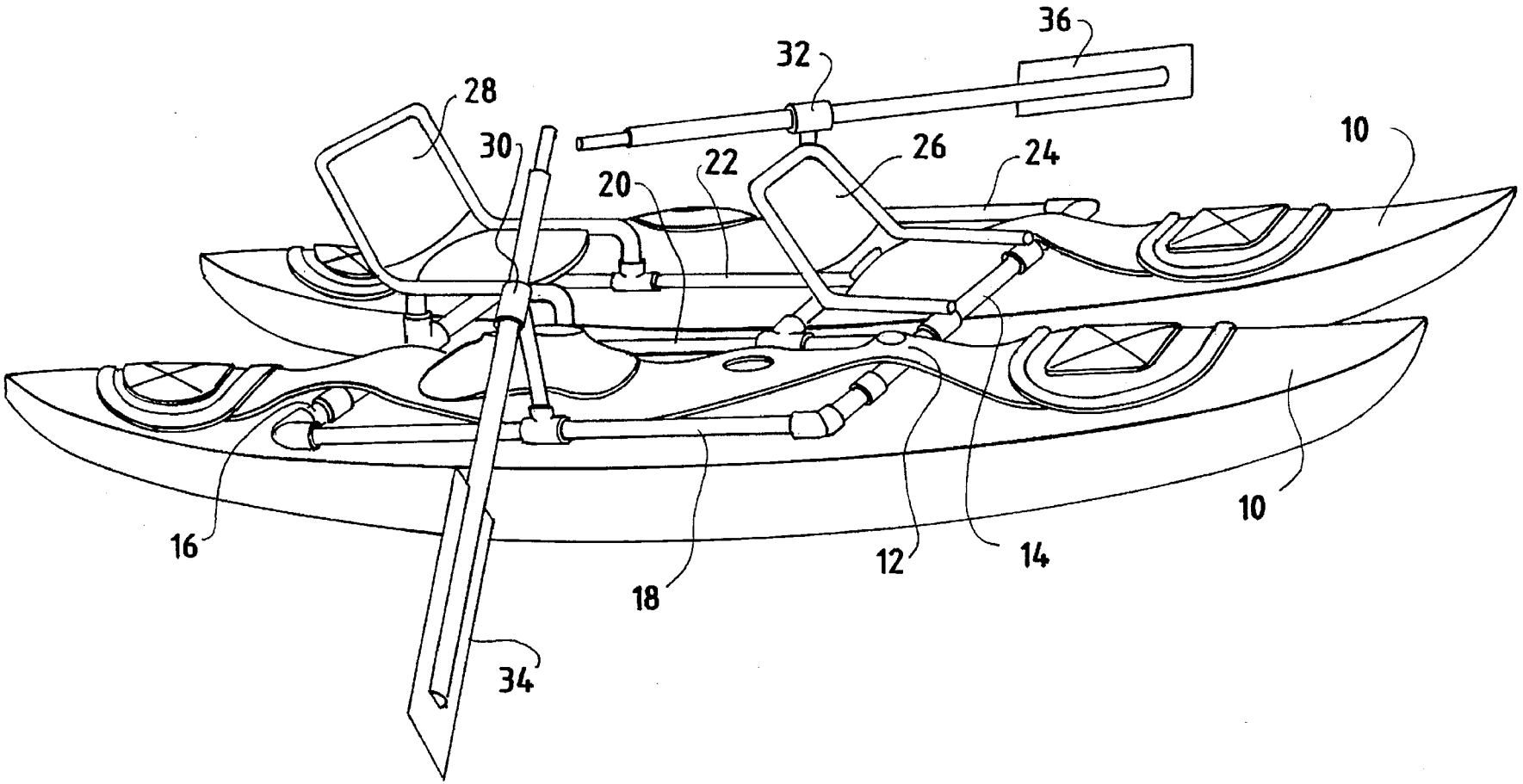
FIG. 1 is a perspective view illustrating the dual-hulled kayak with boaters seated in a rowing position.
Figure 2:
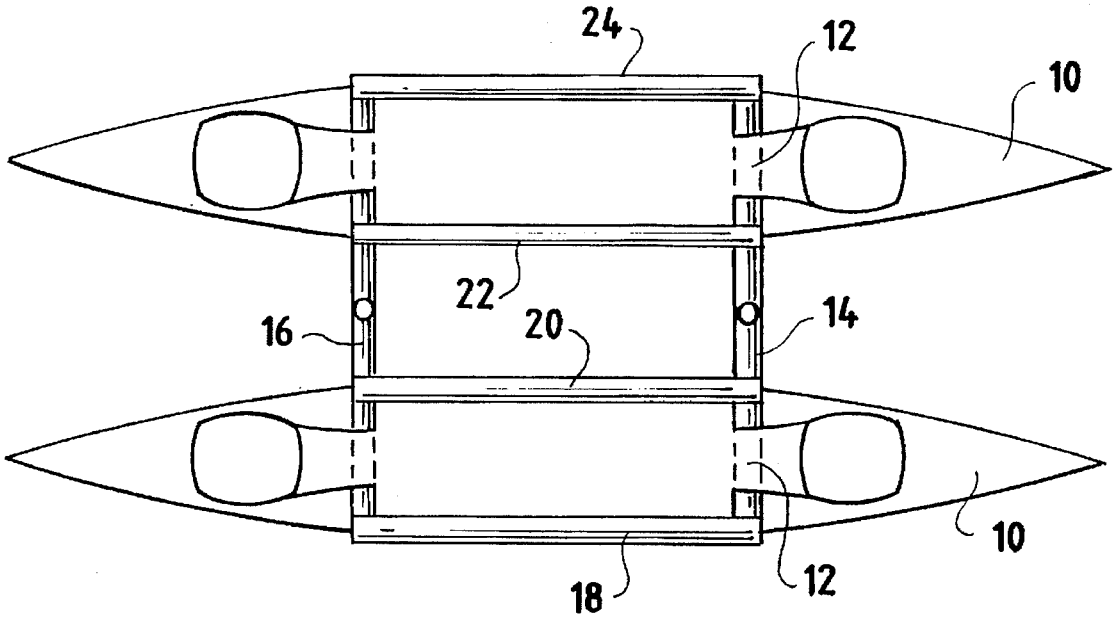
FIG. 2 is a top plan view of the dual-hulled kayak and the rigid frame structure associated with it.
Figure 3:
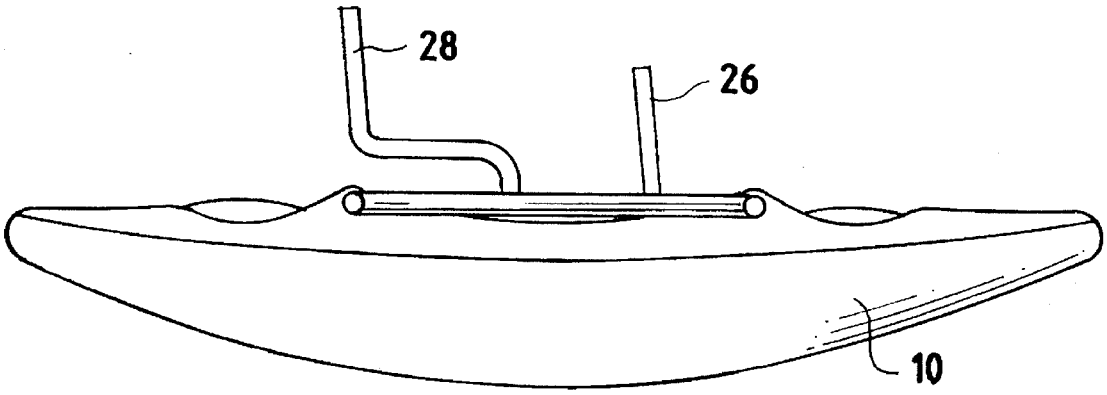
FIG. 3 is an end elevation view showing the general shape of the hull and the rigid frame structure.

Referring to the drawings, which illustrate one embodiment of the invention claimed, a pair of hulls 10 made from a suitable polymeric material, such as polyethylene, is used to form each of the hulls. One preferred form of the hull structures is described in greater detail in U.S. Pat. No. 5,189,974 and can be made by a conventional vacuum or blow molding technologies. Each hull preferably has a molded openings 12 that can accommodate portions of the frame structure.

The molded openings 12 are part of the hull structure which is made of a one-piece construction. The two aluminum frame members 14 and 16 fit under the openings which, as noted above, are actually blended into the hull as part of its one-piece construction.

The frame itself is desirably made of Schedule 40 aluminum stock. Schedule 40 aluminum is the preferred material for the frame structure because of its strength in maintenance free characteristics. Two longitudinally spaced members 14 and 16 are connected with four intersecting lateral members 18, 20, 22 and 24. The two innermost lateral members 20 and 22 support forward and aft seats 26 and 28 which are secured to the frame members. The two outermost frame members include a plurality of adjustable oar pins 30 and 32 that support oars 34 and 36. The rigid frame structure stiffens the overall boat and improves its performance capability in rapids. The adjustable oar pins, in turn, support oars which allow a single person to row the boat. Typically, two eight-foot oars are secured to the oar pins which, in turn, extend up from and are secured to the rectangular frame structure. The preferred height of the oar pin above the frame is between zero and ten inches, although nine and one-quarter inches has been found to be ideal for most conditions. The forward and aft seats, in turn, are secured to the innermost portion of the frame.

In a preferred mode, the overall length of the dual-hulled kayak is approximately 12 feet and the width of the structure is about five feet from the outermost end of one hull to the outermost end of the other. It has been found particularly desirable that the spacing between the longitudinal axis of the two hulls be adjusted between one-third and one-half the length of the hulls themselves. This provides an optimum performance in navigating white water rapids. The most desirable spacing is approximately five-twelfths the length of the hulls.

As can be seen in the dual-hulled kayak design of the present invention, it is configured for front and back passengers with the rear passenger doing the rowing, rather than side-by-side paddlers. In addition, rather than paddling, the boat is designed for rowing which, in turn, provides greater control and responsiveness.

In use, the boat of the present invention provides a different recreational experience than a kayak, raft or catamaran. It is more stable than a kayak and more responsive and controllable than a structure with paddles positioned on each hull The double hull designs allows for greater stability than a kayak and responds quickly to push and pull on the oars. In addition, the use of a polyethylene hull and aluminum frame effectively eliminates expensive maintenance.

While what is described above is a preferred embodiment of the invention, it should be understood that the description is merely an example of how the invention can be practiced. It should therefore, be understood that changes in the variations in the preferred embodiment can be made without departing from the true spirit and scope of the invention as defined in the following claims.

What is claimed is:

1. A specialized, highy maneuverable dual-hulled kayak capable of use in river white water recreational activities that involve high-water rapids comprising:

two laterally-spaced plastic hulls capable of withstanding forces created in white water river expeditions involving rapids;

a frame structure of a strength approximately equivalent to schedule 40 aluminum rigidly connecting the hulls and having two interconnected, longitudinally spaced members and four intersecting lateral members; and the two innermost lateral members supporting spaced forward and aft seats secured to said two innermost lateral members and the two outermost lateral members having a plurality of oar pins to support oars on each side of the kayak adjacent the forward and aft seats to allow rowing of the dual-hulled kayak through rapids, wherein the spacing between the longitudinal axis of the two hulls can be adjusted between one-third and one-half the length of the hulls to accommodate differing river flow, level and debris conditions.

2. The dual-hulled kayak of claim 1 wherein the spacing between the longitudinal axis of the two hulls is about five-twelfths the length of the hulls.

3. The dual-hulled kayak of claim 1 wherein the two longitudinally spaced frame members fit under a molded recess formed in each of the hulls.

4. The kayak of claim 3 wherein the frame is made from lightweight aluminum.

5. The kayak of claim 1 wherein the two hulls are pointed to improve the kayak's performance through waves.

6. The kayak of claim 5 wherein the oar pin length is adjustable from between zero and ten inches above the frame.

* * * * *